US007094986B2

(12) United States Patent
Shea

(10) Patent No.: US 7,094,986 B2
(45) Date of Patent: Aug. 22, 2006

(54) ARC CHUTE ASSEMBLY

(75) Inventor: John J. Shea, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/011,692

(22) Filed: Dec. 14, 2004

(65) Prior Publication Data

US 2006/0124602 A1 Jun. 15, 2006

(51) Int. Cl.
*H01H 33/02* (2006.01)

(52) U.S. Cl. ..... 218/157; 218/38; 218/149

(58) Field of Classification Search ..... 218/34, 218/35, 38, 1, 15, 18, 148–151, 156–158; 335/201, 202

See application file for complete search history.

(56) References Cited

U.S. PATENT DOCUMENTS 3,662,133 A * 5/1972 Bould et al. ..... 218/34
3,749,867 A * 7/1973 Rexroad ..... 218/15
4,748,301 A * 5/1988 Goldman et al. ..... 218/150
4,950,852 A * 8/1990 Goldman et al. ..... 218/150
5,247,142 A * 9/1993 Yonkovitz et al. ..... 218/150
5,589,672 A * 12/1996 Uchida et al. ..... 218/34
5,861,596 A 1/1999 Grass et al.
6,297,465 B1 * 10/2001 Groves et al. ..... 218/151
6,703,576 B1 3/2004 Chou et al.
6,825,431 B1 * 11/2004 Azzola et al. ..... 218/156
2003/0000925 A1 * 1/2003 Azzola et al. ..... 218/153

* cited by examiner

*Primary Examiner*—Elvin Enad
*Assistant Examiner*—M. Fishman
(74) *Attorney, Agent, or Firm*—Martin J. Moran

(57) ABSTRACT

The arc plates of an arc chute assembly for a circuit breaker are supported in spaced, stacked relation by a structural shell molded of a gas evolving resin. Generation of arc gases, that cool the arc thereby increasing the current interruption capability of the breaker, can be further enhanced by gas evolving additives included in the resin. Arc gas flow is increased to further cool the arc by molding the interior walls of the structural shell to form venturies between the arc plates. One or more elongated fibers wrapped around the stack of arc plates in an oval strengthen the structural shell to withstand the increased pressure generated by the high arc gas volume.

3 Claims, 3 Drawing Sheets

ARC CHUTE ASSEMBLY

BACKGROUND OF THE INVENTION

1. Field of the Invention

This invention is directed to arc chute assemblies that assist in extinguishing arcs formed as the separable contacts of a circuit breaker open under load. More particularly, aspects of the invention are directed toward generation of increased gas during current interruption and directing the flow of those gases to promote arc cooling and more rapid termination of the arc, while at the same time, containing the increased gas pressure.

2. Background Information

The current interruption capability of air circuit breakers is dependent in part upon their ability to extinguish the arc that is generated when the breaker main contacts open. Even though the contacts separate, current continues to flow through the ionized gases formed by vaporization of the contacts and surrounding materials. Effective current limiting requires fast and efficient cooling of the arc. The arc is extinguished through transfer to a set of stacked metal plates in an arc chute. The basic geometry has been optimized over the years for the number of plates, plate spacing, and a variety of throat shapes. This stack of metal plates increases the arc voltage in an air circuit breaker to produce a current-limiting effect thereby providing downstream protection. The process of increased arc voltage results from cooling the arc and splitting the arc into series of arcs. Cooling results from arc attachment to the metal plates, vaporization of the plates and insulating materials, and discharge of the hot gases out of a vent. Arc splitting into a series of arcs also results in increased arc voltage due to additional cathode fall potentials. Magnetic materials, for example, steel, are used for the arc plates for their ability to attract the arc due to the self-induced magnetic field produced from the fault current. In addition, arc cooling depends on the gas flow over the plates (convection) and hot gas removal out of the vent of the circuit breaker. The volume of gas generated during current interruption has been enhanced by coating the support structure for the stacked metal plates with gas evolving materials such as cellulous filled melamine formaldehyde, glass polyester filled with alumina trihydrate (ATH) or by providing inserts made of such materials. While increasing the volume of gas generated during current interruption and enhancing its flow aids in extinguishing the arc, it also increases pressure within the circuit breaker, and therefore, on the arc chute and the circuit breaker casing. This can limit the current interruption capability of the circuit breaker.

There is a need, therefore, for improvements in arc chute assemblies for circuit breakers.

SUMMARY OF THE INVENTION

This invention satisfies this need and others by providing an arc chute assembly for a circuit breaker that enhances the generation of arc gases during current interruption to limit current, enhances flow of the increased arc gases and better withstands the increased pressures generated by the additional arc gases.

In accordance with aspects of the invention, arc cooling is enhanced by an arc chute assembly having a support structure for the stack of arc plates comprising a shell molded of a gas evolving resin that may be selected from a group comprising: cellulose filled melamine formaldehyde, cellulose filled urea formaldehyde, polyacetal (POM), ATH filled polyester, glass filed nylon 6/6, nylon 6/6, and polytetrafluoroethylene (PTFE). Gas generation, and therefore cooling, can be further enhanced by adding to the resin a gas evolving additive selected from a group comprising: boric acid, urea, guanine, guanidine carbonate, allantoin, hydantoin and alumina trihydrate.

In accordance with additional aspects of the invention, an arc chute assembly that is better able to withstand the pressure generated by the arc gases has a support structure that comprises at least one elongated fiber transversely surrounding the stack of arc plates. This elongated fiber can be embedded in the molded shell, and can be for example, at least one elongated fiber repetitively wound around the stack of arc plates or a plurality of such fibers, such as for example, a fabric having additional fibers extending transversely to the elongated fibers.

In accordance with another aspect of the invention, the support structure comprises an oval shell having a major axis transverse to the arc plates. This shell may be molded, and whether oval or not, can have sidewalls in which the arc plates are seated in slots and which can converge from the leading edge of the arc plates and then diverge toward the trailing edges to form venturies that improve gas flow toward the trailing edges for enhanced cooling and movement of the arc deeper into the arc plates.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
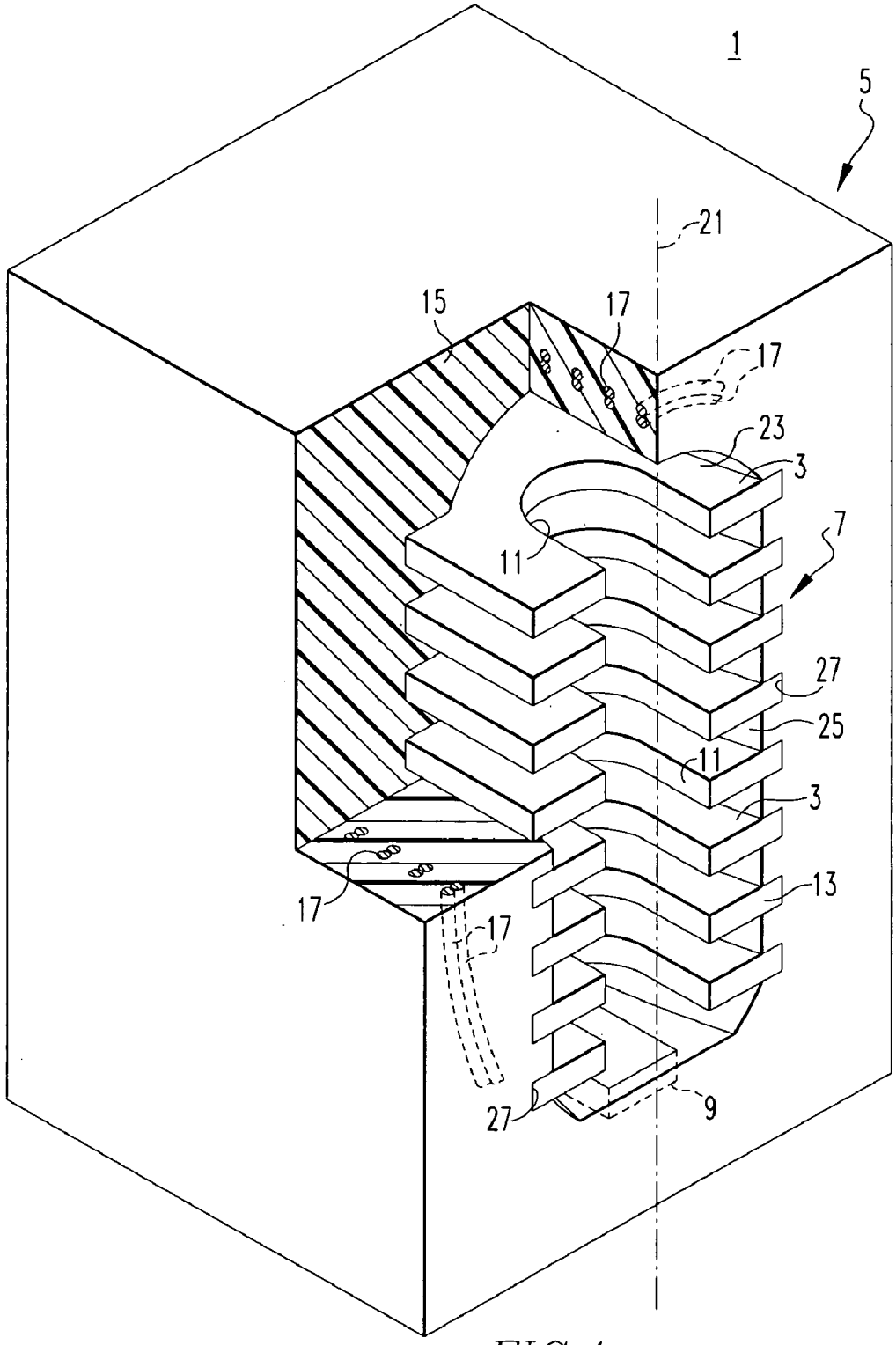
FIG. 1 is an isometric view of an arc chute assembly illustrating aspects of the invention.

Referring to the figures, an arc chute assembly 1 in accordance with aspects of the invention is made up of a number of arc plates 3 that are supported in spaced, stacked relation by a support structure 5. Typically, the arc at the bottom of the stack 7 of arc plates 3 is an arc runner 9, as is conventional. The arc plates 3 and arc runner 9 are typically made of an electrically conductive magnetic material such as steel. The arc plates 3 can have notches 11 in the leading edges 13 so they partially extend around the path of a moving arm in the circuit breaker carrying the movable contact (not shown) as is well known.

In accordance with aspects of the invention, the support structure 5 is a unitary structural shell molded of an electrically insulated resin 15. In accordance with the aspects of the invention, the resin contains a gas evolving material. Such gas evolving material can include cellulose filled melamine formaldehyde, cellulose filled urea formaldehyde, polyacetal (POM), ATH filled polyester, glass filled nylon 6/6, nylon 6/6, and polytetrafluoroethylene (PTFE). Heat generated by the arc created as the contacts of the circuit breaker (not shown) in which the arc chute assembly 1 is used vaporizes some of the gas evolving material forming the support structure to create arc gases. This process results in absorption of some of the heat thereby cooling the arc. In addition, the arc gases are vented to further remove heat and lower the arc temperature. The arc gases generated from the gas evolving resin forming the molded structural shell 5 is in addition to the gases formed by vaporization of the contacts of the circuit breaker and of the arc plates. The additional arc gases evolved from the molded structural shell 5 permits the same circuit breaker to have a higher current interruption capability.

In accordance with other aspects of the invention, additional arc gases can be generated by including gas evolving additives in the resin. Such additives can include boric acid, urea, guanine, nylon 6/6 and alumina trihydrate. Such additives further increase the current interrupting capability of a circuit breaker in which the arc chute assembly in accordance of this aspect of the invention is used.

Figure 2:
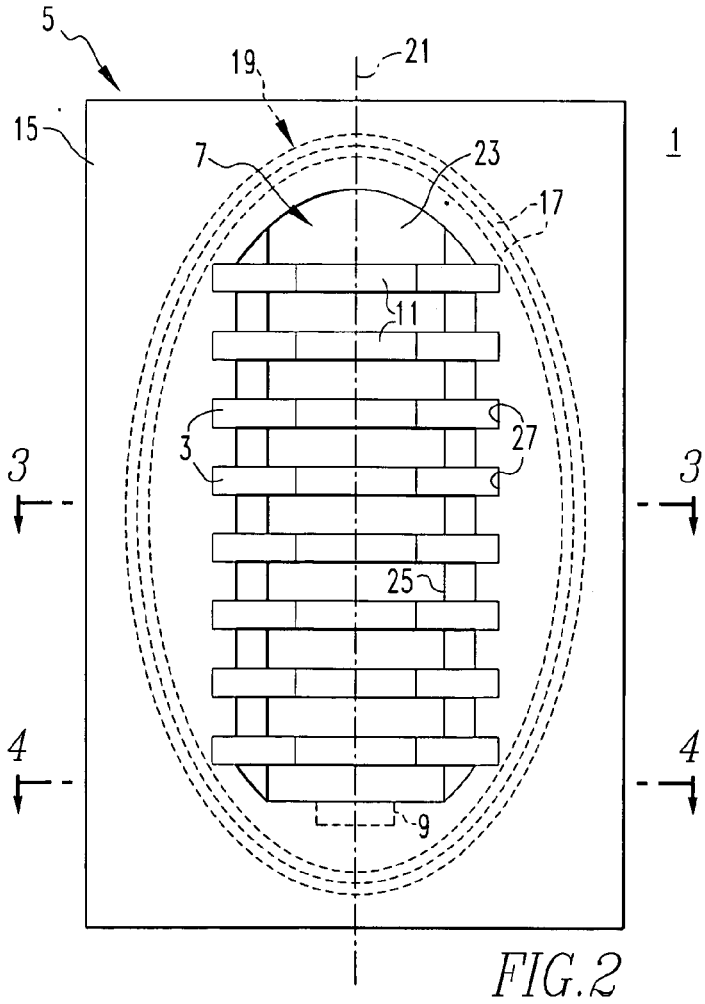
FIG. 2 is a vertical sectional view through the arc chute assembly of FIG. 1 taken along the line 2—2.

The volume of arc gases generated in the arc chute assembly 1 in accordance with the invention results in increased arc gas pressure. In accordance with additional aspects of the invention, the molded structural shell 5 is reinforced by an elongated fiber 17 that extends transversely around the stack 7 of arc plates 3, and is preferably imbedded in the resin 15. While at least one elongated fiber 17 extends around the molded structural shell 5, in the embodiment shown in the drawings there are two such elongated fibers 17 that are repetitively wound around the stack of arc plates 7 in two layers. The number of layers of the elongated fibers 17 are dependent upon the type and size of the fiber and the peak gas pressure generated by the arc gases. As shown in FIG. 2, the elongated fibers 17 form an oval cage having a major axis 21 that is perpendicular to the planes of the arc plates 3. The exact shape of the cage 19 is dependent upon the relative height and width of the stack 7 of arc plates 7. The elongated fibers 17 can be: glass fiber, Kevalar™, carbon fiber, magnetic steel wire, and magnetic stainless steel wire. Ferromagnetic materials, such as steel, will enhance the magnetic field surrounding the arc plates, thereby aiding in the desired increase in arc motion into the arc chute. The electrically conductive fibers must be insulated from the arc plates by the molded resin or by some other means. Alternatively, the elongated fibers can be threads of a fabric that would have additional fibers extending transversely to the plurality of elongated fibers 17 shown in FIG. 2.

As shown in FIG. 2, the molded structural shell 5 has a thru opening 23 with sidewalls 25 having molded slots 27 in which the arc plates 3 and arc runner 9 are seated. The arc plates 3 and runner 9 can be molded in place in the molded shell 5 or can be slid into the slots 27 after molding.

Figure 3:
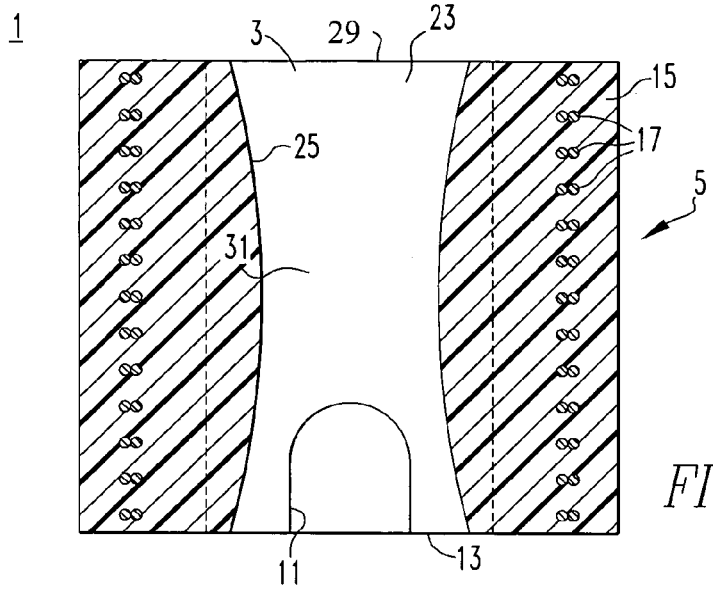
FIG. 3 is a horizontal sectional view through the arc chute assembly of FIG. 1 taken along the line 3—3.

As seen in FIG. 3, in accordance with other aspects of the invention, the sidewalls 25 of the thru opening 23 in the support structure 5 converge in extending rearward from the leading edges 13 of the arc plates 3 and then diverge in the direction of the trailing edges 29 of the arc plates 3 to form venturies 31. These venturis 31 accelerate the flow of arc gases through the arc chute assembly 1 toward vents (not shown) in the housing of a circuit breaker in which the arc chute assembly 1 is installed. Again, this aids in cooling the arc and therefore increases the current interrupting capability of a circuit breaker in which the arc chute assembly 1 is incorporated.

The outer configuration of the molded structural shell 5 while shown as a rectangular parallelepiped, it can be molded in any shape to accommodate the cavity provided for it in the circuit breaker in which it is to be employed.

Arc chute assemblies 1 in accordance with various aspects of the invention improve the arc interrupting capability of a circuit breaker in which they are used by increasing the volume of arc gases generated from the gas evolving resin, and if used, from the gas evolving additives in the resin. Interruption capability is further enhanced by increasing the flow rate of the arc gases generated away from the arc by molding the interior sidewalls of the molded support shell to form venturies. In accordance with another aspect of the invention, the ability of the arc chute assembly and therefore the circuit breaker in which it is used to withstand the higher pressures generated by the increased volume of arc gases is enhanced by surrounding the opening containing the arc plates with one or more elongated fibers of high strength material. Another advantage, is that the support shell can be molded to conform to the space available in the circuit breaker and is easily constructed either by molding the arc plates in the shell or sliding the arc plates into molded slots in the shell.

Figure 4:
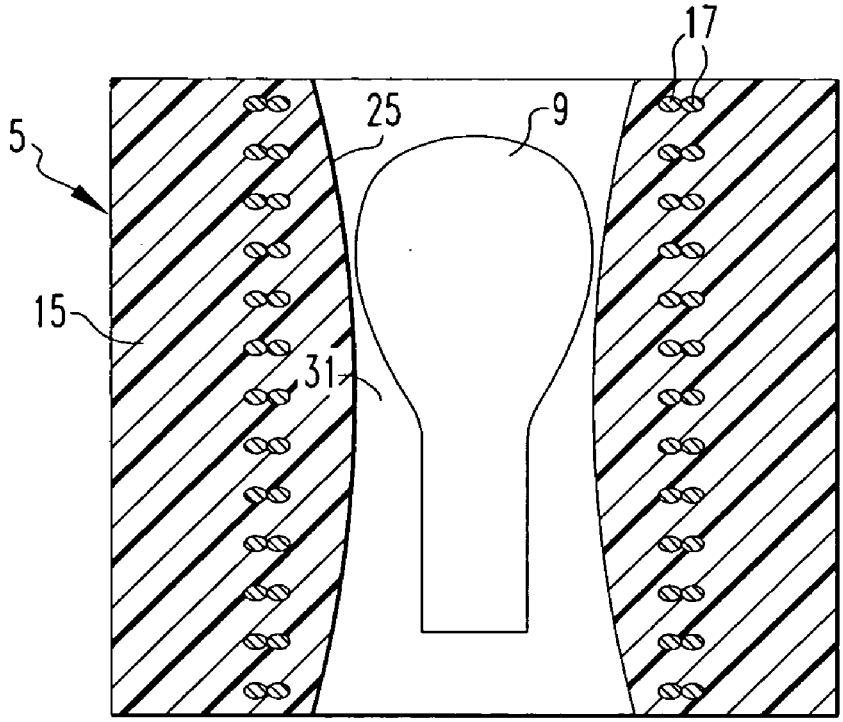
FIG. 4 is a sectional view showing the arc runner seated in a recess in the molded structural shell of the arc chute assembly.

In accordance with another embodiment shown in FIG. 4, the arc runner 9 can be seated flush in a recess in the molded gas evolving resin 15 forming the molded structural shell 5, with or without the additives, to enhance the generation of arc gases.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An arc chute assembly for a circuit breaker, the arc chute assembly comprising:

a plurality of arc plates each having a leading edge and a trailing edge;

a support structure supporting the plurality of arc plates in spaced relation in a stack, the support structure comprising at least one elongated fiber transversely surrounding the stack of arc plates;

wherein the support structure further comprises a molded shell extending transversely around the stack of arc plates;

wherein the at least one elongated fiber is imbedded in the molded shell;

wherein the at least one elongated fiber comprises an elongated fiber repetitively wound around the stack of arc plates; and wherein the elongate fiber is wound around the arc plates in an oval having a major axis perpendicular to the arc plates.

2. An arc chute assembly for a circuit breaker, the arc chute assembly comprising:

a plurality of arc plates each having a leading edge and a trailing edge;

a support structure supporting the plurality of arc plates in spaced relation in a stack, the support structure comprising at least one elongated fiber transversely surrounding the stack of arc plates;

wherein the support structure further comprises a molded shell extending transversely around the stack of arc plates;

wherein the molded shell comprises a gas evolving resin from which gas evolves in response to an arc;

wherein the molded shell has internal side walls with molded slots in which the arc plates are seated; and wherein the internal side walls of the molded shell converge from the leading edges of the arc plates then diverge toward trailing edges to form venturies.

3. An arc chute assembly for a circuit breaker, the arc chute assembly comprising:

a plurality of arc plates each having a leading edge and a trailing edge;

a support structure supporting the plurality of arc plates in spaced relation in a stack with the leading edges positioned to receive an arc, the support structure comprising a molded structural shell transversely surrounding the stack of arc plates;

wherein the molded structural shell is molded of a resin and has at least one elongated fiber imbedded in the resin and wound repetitively around the stack of the plates;

wherein the molded structural shell has internal side walls with molded slots in which the arc plates are seated; and wherein the internal side walls converge from leading edges of the arc plates and then diverge toward trailing edges of the arc plates to form venturies.

* * * * *